US006718987B1

(12) United States Patent
Pogossian et al.

(10) Patent No.: US 6,718,987 B1
(45) Date of Patent: Apr. 13, 2004

(54) SMOKERS' ARTICLE

(76) Inventors: Seiran Pogossian, Selo "Novoe", Pereslavsky raion, Yaroslavskaya obl. (RU), 152149; Semen Pogossian, Selo "Novoe", Pereslavsky raion, Yaroslavskaya obl. (RU), 152149

( * ) Notice: Subject to any disclaimer, the term of this patent is extended or adjusted under 35 U.S.C. 154(b) by 0 days.

(21) Appl. No.: 09/936,443

(22) PCT Filed: Feb. 23, 2000

(86) PCT No.: PCT/RU00/00060

§ 371 (c)(1),
(2), (4) Date: Sep. 10, 2001

(87) PCT Pub. No.: WO00/57734

PCT Pub. Date: Oct. 5, 2000

(30) Foreign Application Priority Data

Mar. 12, 1999 (RU) ..... 99104408

(51) Int. Cl.[7] ..... A24F 1/04; A24D 3/04

(52) U.S. Cl. ..... 131/211; 131/339; 131/360; 131/361; 131/340; 131/200; 131/202; 131/331; 131/343

(58) Field of Search ..... 131/361, 201, 131/338, 343, 339, 336, 211, 212.1, 200, 202, 331, 335, 346, 360, 345

(56) References Cited

U.S. PATENT DOCUMENTS

| | | | | | |
|---|---|---|---|---|---|
| 2,005,661 | A | * | 6/1935 | Muller | 131/5 |
| 2,389,104 | A | * | 11/1945 | Bauer et al. | 131/8 |
| 2,979,058 | A | * | 4/1961 | Schur | 131/10 |
| 3,025,861 | A | * | 3/1962 | Cobb | 131/208 |
| 3,498,299 | A | | 3/1970 | White | |
| 3,524,450 | A | | 8/1970 | Molins | |
| 4,073,300 | A | * | 2/1978 | Molins | 131/61 A |
| 4,393,885 | A | | 7/1983 | Silberstein | |
| 4,525,385 | A | * | 6/1985 | Pryor | 427/177 |
| 4,856,540 | A | * | 8/1989 | Jansma et al. | 131/339 |
| 4,896,682 | A | | 1/1990 | Liew | |
| 5,839,449 | A | * | 11/1998 | Banerjee et al. | 131/342 |
| 6,257,242 | B1 | * | 7/2001 | Stavridis | 131/344 |

FOREIGN PATENT DOCUMENTS

| | | |
|---|---|---|
| DE | 1 278 914 | 9/1968 |
| DE | 1 782 478 | 1/1972 |
| FR | 2 497 636 | 1/1982 |
| GB | 1 330 936 | 9/1973 |
| GB | 2159386 | * 12/1985 |
| GB | 2 203 324 | 10/1988 |
| SU | 259745 | 4/1970 |
| SU | 1802691 | * 3/1993 |

* cited by examiner

*Primary Examiner*—Dionne A. Walls
(74) *Attorney, Agent, or Firm*—Dellett & Walters

(57) ABSTRACT

The present invention pertains to the tobacco industry and may be used in the production of smokers' articles that include a mouthpiece and consist of a new product that conjugates the functional properties and qualities of cigarettes with a cardboard mouthpiece and of filter cigarettes. To this end, this smokers' article comprises a tobacco rod wrapped in a separate sleeve of cigarette paper as well as a flexible and elongated mouthpiece which is connected to said rod and has the size of a cardboard mouthpiece. The mouthpiece is made of a pressed fibrous material and includes a filter member, which is arranged on the tobacco rod side, which is integral with the tubular portion of the mouthpiece and which is made in the shape of a continuous cylinder having a diameter equal to that of the mouthpiece tubular portion. The tobacco rod is connected to the mouthpiece by a paper ring. The fact that the cylindrical filtration member is integral with the mouthpiece and consists of the same fibrous material prevents the smoke from flowing without undergoing a filtration cycle in the mouthpiece and also prevents tobacco chips from falling therein.

20 Claims, 4 Drawing Sheets

SMOKERS' ARTICLE

FIELD OF INVENTION

The present invention pertains to the tobacco industry and may be used in the production of smokers' articles that include a mouthpiece and consist of a new product conjugating the functional properties and qualities both of cigarettes with a cardboard mouthpiece and of filter cigarettes.

PRIOR ART

Known in the art are different types of cigarettes that have in common a tobacco rod wrapped in a sleeve made of cigarette paper, a shortened paper mouthpiece and an autonomous, immovable and solid filter member, wherein all the elements being connected so as to shape a single article by a paper ring overlapping a portion of the tobacco rod, the filter member and the mouthpiece; U.S. Pat. No. 3,498,299, IPC A24D 1/04, 1970; GB Pat. 2,203,324, IPC A24D 1/04, 1988.

Also known in the art is a cigarette with a movable filter member, which consists of a tobacco rod wrapped in a sleeve made of cigarette paper and a paper mouthpiece connected thereto; the said mouthpiece contains a nylon or polyethylene filter member made in the shape of a sliding piston moving inside the mouthpiece with raise in the smoke pressure during smoking and adjusting the volume of air inflow; additional filter members, made of acetate fiber, may be arranged at the inlet end or at the outlet end of the mouthpiece; GB Pat. 1,330,936, IPC A24D 1/04, 1973.

Also known in the art are cigarettes having a paper mouthpiece and a shortened tobacco rod wrapped in a sleeve made of cigarette paper and connected with the said mouthpiece with a paper ring; DE Pat. 1,782,478, IPC A24D 1/04, 1975. Known in the art are cigarettes containing a paper mouthpiece connected by a paper ring with a tobacco rod wrapped in a sleeve made of cigarette paper, wherein a cylindrical insert with holes is arranged in the mouthpiece and shapes two combustion chambers for smoke and the said mouthpiece has holes for air inflow along its perimeter; DE Pat. 1,278,914, IPC A24D 1/04, 1968; FR Pat. 2,497,636, IPC A24D 1/04, 1982.

Also known in the art are cigarettes containing a tobacco rod wrapped in a sleeve made of cigarette paper and a tubular filter member adjacent to the said tobacco rod, one end of the said filter member having a bottom part with a slot therein, which is connected to the said end of the tobacco rod, and the other end of the filter member is open and may have a solid additional filter member closing the said opened end; U.S. Pat. No. 4,896,682, IPC A24D 1/04, 1990.

The common feature of all the above cigarettes is that the filter member or the shortened mouthpiece is held between the lips, and the cigarette is held between fingers in the area of the tobacco rod or at the point of its junction with the filter member. Such smoking leads to yellowing of the fingers' skin and nails, and in a case where a cigarette is held by the shortened mouthpiece only, fingers touch the lips, which is undesirable. In a wet weather cigarette paper of the tobacco rod, as in contact with wet fingers, is destroyed and one has to smoke cigarettes holding them by the thumb and the forefinger only by the shortened mouthpiece, which is often not convenient and not hygienic, since fingers touch the portion of the mouthpiece that is intended to be held by the lips.

The said disadvantages are partially eliminated by a smokers' article of another type, which is a cigarette with a cardboard mouthpiece. Such a cigarette has an elongated cardboard mouthpiece intended for holding the cigarette with fingers without touching the tobacco rod and allows not to touch its portion that is intended for holding by the lips.

However, smokers' articles in the shape of cigarettes with an elongated cardboard mouthpiece of high quality and with an advanced filter member are not widely used by now.

Known in the art is a smokers' article consisting of a tobacco rod wrapped in a sleeve made of cigarette paper, an elongated cardboard mouthpiece and an autonomous immovable solid filter member located in the outlet portion of the mouthpiece, the latter being connected to the tobacco rod with a paper ring; U.S. Pat. No. 3,524,450, IPC A24D 1/04, 1970; SU Pat. 259745, IPC A24D 1/04, 1970.

This smokers' article is not widely used because the tubular mouthpiece made of paper gets wet, collapsed, and the smoke may bypass the filter member, going between the exterior surface of the filter member and the paper mouthpiece overlapping it.

DESCRIPTION OF INVENTION

It is an object of this invention to create a smokers' article of new type having advantages of both usual cigarettes and cigarettes with a cardboard mouthpiece, but, at the same time, having no disadvantages peculiar to the both commonly known types of smokers' articles.

This object is attained in a smokers' article that comprises a tobacco rod wrapped in a separate sleeve made of cigarette paper and an elongated and resilient mouthpiece which is connected to the said rod and has the size of a cardboard mouthpiece (that is, the tubular part of a mouthpiece exceeds 40 mm). The mouthpiece is made of a pressed fibrous material and includes a filter member which is arranged on the tobacco rod side, is integral with the tubular portion of the mouthpiece and is made in the shape of a continuous cylinder having a diameter equal to that of the mouthpiece tubular portion. The length of the said mouthpiece exceeds that of the tobacco rod, and the length of the said cylindrical filter member is at least half as great as the length of the tobacco rod and at least one third as great as the length of the said tubular portion of the mouthpiece. The tobacco rod is connected to the elongated mouthpiece with a paper ring overlapping, at least, the surface of the cylindrical filter member, and the fibrous material of the mouthpiece is pressed to such a degree so as to ensure restoration of the tubular portion open flow area after removal of compressive load under which the tubular portion has been fully compressed.

As a material for making a resilient mouthpiece and, consequently, a cylindrical filter member acetate fiber may be used, which is used for making cigarette filter members.

An additional filter member made of activated carbon or the like materials may be arranged between the tobacco rod and the cylindrical filter member.

An additional filter member may be also arranged behind the cylindrical filter member inside the tubular portion of the mouthpiece.

The said resilient and elongated mouthpiece made of a pressed fibrous material may be wrapped in a paper sleeve, and the said paper ring may be connected with a glue to the outer surface of the said paper sleeve.

The resilient and elongated mouthpiece made of a pressed fibrous material may have the plasticized outer surface that enables not to enclose it in an additional paper sleeve, since a plasticized surface is free from roughness peculiar to a fibrous structure and protects the outer surface of fibers from splitting during smoking.

As a plasticizer a polyvinyl acetate emulsion may be used, which is a product obtained by polymerizing vinyl acetate in an aqueous medium under heating in the presence of an emulsifier. Also, other plasticizers may be used which are compatible with a given fibrous material of the tubular mouthpiece and capable of forming a thin, smooth and monolith layer with outer fibers of the said fibrous material. This procedure of making completely prevents smoke from passing through the mouthpiece without entering the filter member.

A resilient and elongated mouthpiece made of a pressed fibrous material and having the plasticized outer surface may have a ring section not covered with a plasticizer and arranged after the paper ring to ensure additional air inflow when smoking.

Such a smokers' article ensures a high intake of substances contained in smoke, i.e. nicotine, tars, etc., since it has a large active adsorbing surface area.

The fact that the cylindrical filter member is integral with the mouthpiece and consists of the same fibrous material prevents the smoke from flowing without undergoing a filtration cycle in the mouthpiece and also prevents tobacco chips from falling therein. The selected proportions of the smokers' article elements ensure comfort and hygiene when smoking, and the mouthpiece ensures the possibility of holding the article with fingers without touching the lips while smoking and without contact between fingers and the portion held by the lips. The use of a fibrous material for the mouthpiece ensures restoration of its shape after squeezing the mouthpiece with fingers, the smoke, while passing through the said fibrous material cools down, the fibrous structure of the mouthpiece ensures retention of heat and absorption of the lips' moisture, keeping the outer surface dry (mouthpieces made of cigarette paper and cigarette filter members wrapped in cigarette paper get wet during smoking).

BEST EMBODIMENTS OF THE INVENTION

Figure 1:
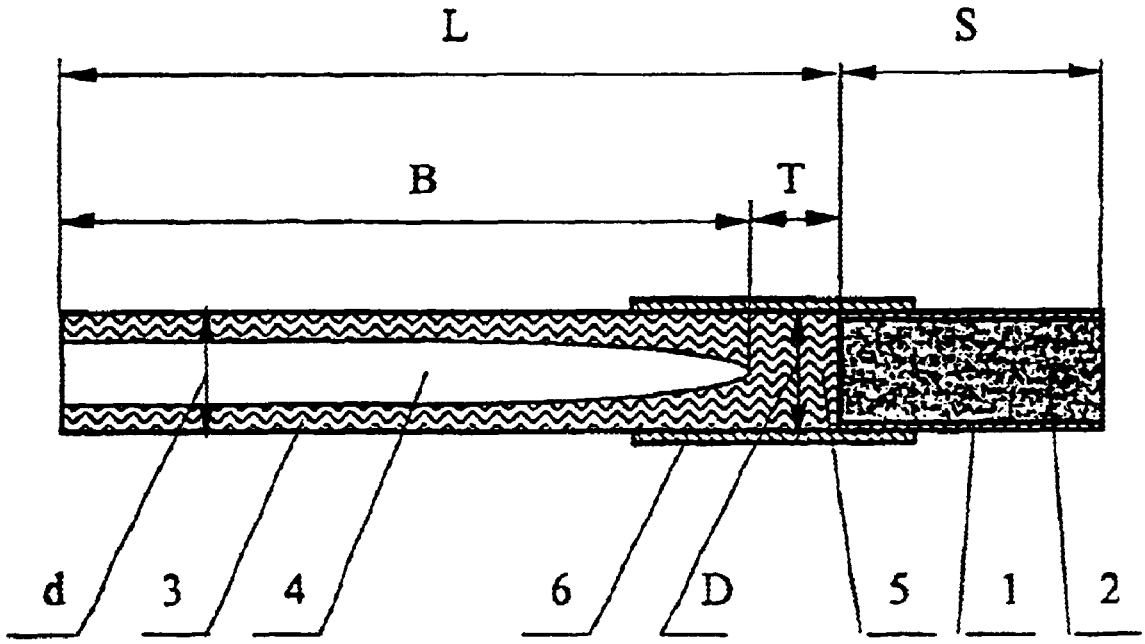
FIG. 1 is a cross sectional view of the smokers' article with a mouthpiece made of a pressed fibrous material wrapped in a paper sleeve.

The smokers' article (FIG. 1–FIG. 6) comprises a tobacco rod 2 wrapped in a separate sleeve 1 made of cigarette paper and a resilient and elongated mouthpiece 3 which is connected to the said rod and has the size of a cardboard mouthpiece (the length of the tubular portion is at least 40 mm). The mouthpiece is made of a pressed fibrous material and has, on the side of the tobacco rod 2, a filter member 5 made integral with the tubular portion 4, said filter being made of the same fibrous material and being made in the shape of a continuous cylinder having a diameter (D) equal to the diameter (d) of the mouthpiece tubular portion. The total length (L) of the said mouthpiece exceeds the length (S) of the tobacco rod, and the length (m) of the cylindrical filter member 5 is at least half as great as the tobacco rod length (S) and at least one third as great as the length (B) of the mouthpiece tubular portion 4. The tobacco rod 1 is connected to the elongated mouthpiece 3 by a paper ring 6 at least overlapping the surface of the cylindrical filter member 5, and the mouthpiece fibrous material is pressed so as to ensure restoration of the open flow area of the tubular portion 4 after removal of the compressive load under which the tubular portion has been fully compressed.

Acetate fiber commonly used for making cigarette filters may be used as a material for making a resilient mouthpiece 3 and, consequently, a cylindrical filter member 5.

Figure 3:
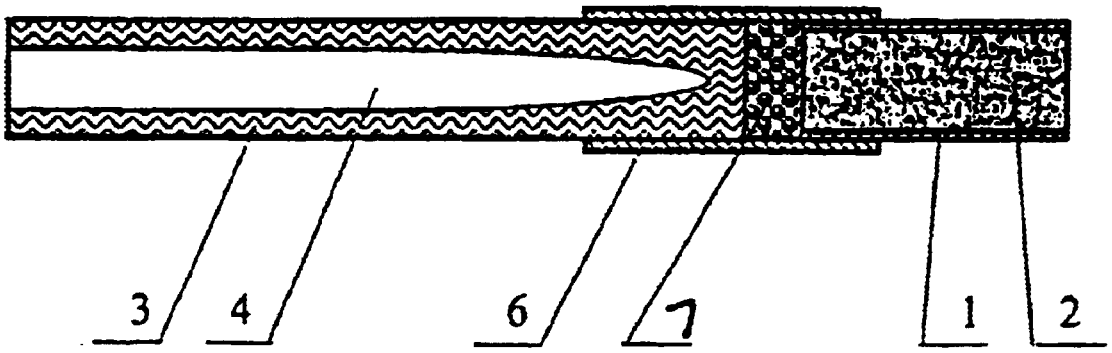
FIG. 3 is a cross sectional view of the smokers' article with a mouthpiece made of a pressed fibrous material and an additional filer member made of activated carbon which arranged behind the tobacco core.

Between the tobacco rod 2 and the cylindrical filter member 5 an additional filter member 7 may be arranged, being made of activated carbon or a similar material (FIG. 3).

Figure 4:
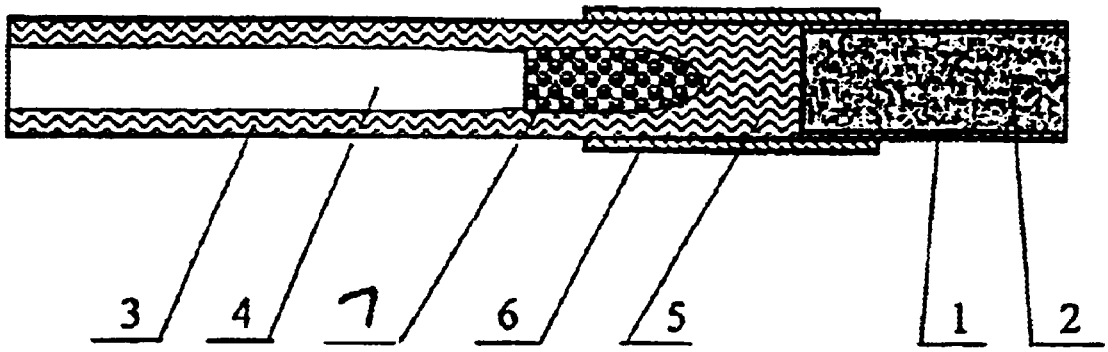
FIG. 4 is a cross sectional view of the smokers' article with a mouthpiece made of a pressed fibrous material and additional filter member made of activated carbon and arranged inside the said mouthpiece.
Figure 5:
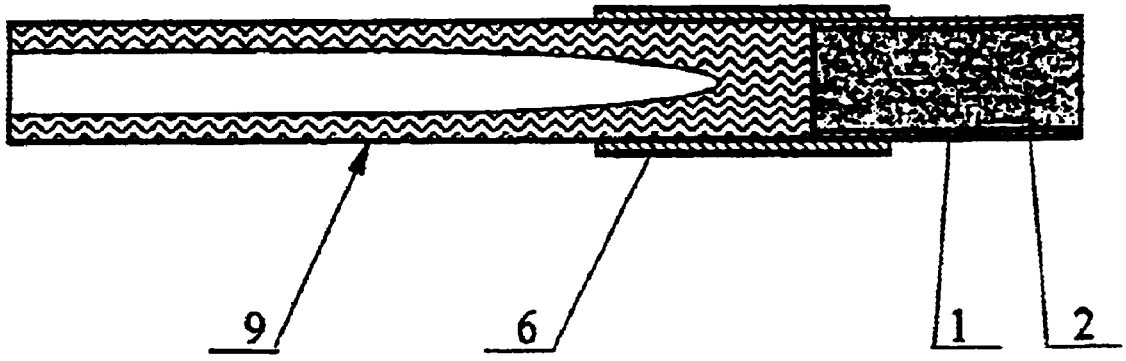
FIG. 5 is a cross sectional view of the smokers' article with a mouthpiece made of a pressed fibrous material and having the plasticized surface.
Figure 6:
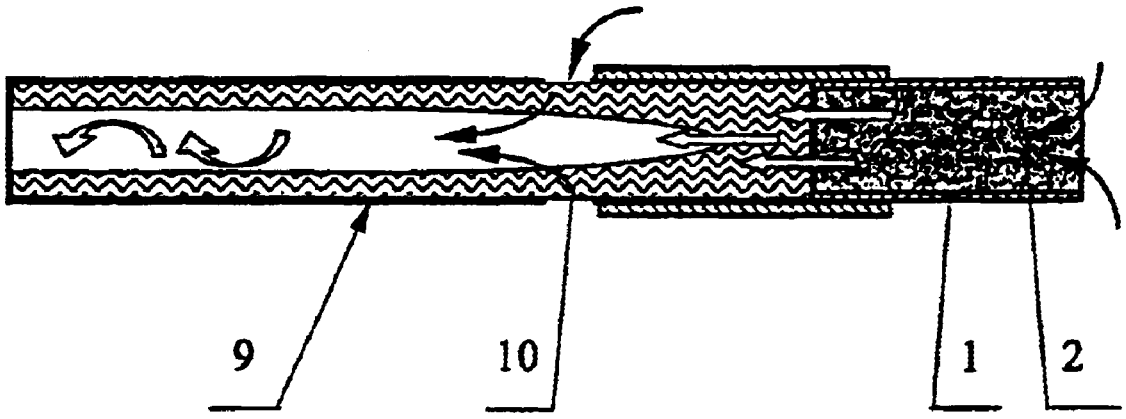
FIG. 6 is a cross sectional view of the smokers' article with a mouthpiece made of a pressed fibrous material having, behind a paper ring, a ring portion that is not covered with a plasticizer. The arrows show how the smoke and aspirated air pass through the elements of the smokers' article.

The said additional filer member 7 may be also arranged behind the cylindrical filter member 5 inside the tubular portion 4 of the mouthpiece (FIG. 4).

Figure 2:
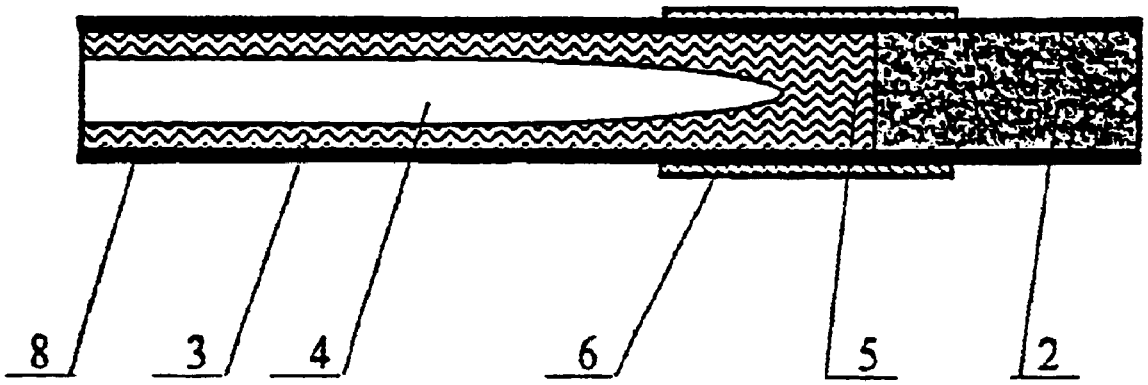
FIG. 2 is a cross sectional view of the smokers' article with a mouthpiece made of a pressed fibrous material and an additional filer member made of activated carbon which is arranged adjacent to the tobacco rod.

The resilient and elongated mouthpiece 3 made of a pressed fibrous material may be wrapped in the paper sleeve 8, and the paper ring 6 may be glued to the outer surface of the paper sleeve 8 (FIG. 2).

The resilient and elongated mouthpiece 3 made of a pressed fibrous material may have the plasticized outer surface 9 (FIG. 5), which makes its wrapping into an additional paper sleeve unnecessary since the plasticized surface is free from roughness conditioned by fibrous structure and protects the outer surface of fibers from splitting during smoking As a plasticizer a polyvinyl acetate emulsion may be used, which is a product obtained by polymerizing vinyl acetate in an aqueous medium under heating in the presence of an emulsifier. Also, other plasticizers may be used which are compatible with a given fibrous material of the tubular mouthpiece and capable of forming a thin, smooth and monolith layer with outer fibers of the said fibrous material. This procedure of making completely prevents smoke from passing through the mouthpiece without entering the filter member.

A resilient and elongated mouthpiece 3 made of a pressed fibrous material and having the plasticized outer surface 9 may have a ring section 10 (FIG. 6) not covered with a plasticizer and arranged after the paper ring 6 to ensure additional air inflow when smoking. The said paper ring 6 may completely overlap the said resilient and elongated mouthpiece 3 (this is not shown on FIGS. 1–6). Such a smokers' article ensures a high intake of substances contained in smoke, i.e. nicotine, tars, etc., since it has a large active adsorbing surface area.

The making of the cylindrical filter member 5 integral with the mouthpiece 3 and of the same fibrous material is highly technological and prevents the smoke from flowing without undergoing a filtration cycle in the mouthpiece and also prevents tobacco chips from falling therein. The selected size relation of the members of the smokers' article ensures comfort and hygiene when smoking. The smokers' article is balanced and may be conveniently held between the middle finger and the forefinger, the thumb being not in contact with the inlet portion of the mouthpiece. The mouthpiece ensures the possibility of holding the smokers' article between the fingers, without touching the lips when smoking.

Some smokers are used to squeeze the mouthpiece between their fingers when smoking and grip it by their teeth. The use of a fibrous material for the mouthpiece ensures restoration of its shape after squeezing the mouthpiece with fingers, the smoke, while passing through the said fibrous material, cools down, the fibrous structure of the mouthpiece ensures retention of warmth and absorption of the lips' moisture, keeping the outer surface dry (mouthpieces made of cigarette paper and cigarette filter members wrapped in cigarette paper get wet during smoking).

In a particular embodiment the smokers' article has the following parameters: total length—120 mm, length of the tobacco rod—50 mm, length of the resilient mouthpiece—70 mm, length of the cylindrical filter member—12 mm, length of the paper ring—35 mm, outer diameter of the mouthpiece—7 mm, inner diameter of the mouthpiece tubular portion—5 mm, mouthpiece material—pressed acetate fiber.

Industrial Applicability

Thus, this smokers' article ensures smoke filtration by the cylindrical filter member and the mouthpiece tubular portion directly connected to the said filter member, but not over its total length. In smoking it practically keeps the mouthpiece portion, which is held between fingers, clean of the smoke and smoke deposits in spite of the fact that the whole mouthpiece is made of the same fibrous filtering material. The smoke, as flowing through the mouthpiece tubular portion, lodges on such a long inner surface, but does not pass through it. Therefore the smoker's fingers do not absorb smoke sediments and remain clean.

What is claimed is:

1. A smokers' article characterized in that it comprises a tobacco rod wrapped in a separate sleeve made of cigarette paper, a resilient and elongated mouthpiece which is connected to said rod and which is made of a pressed fibrous material and includes a filter member arranged on the tobacco rod side and made integral with a tubular portion of said mouthpiece, said filter member being a continuous cylinder with a diameter substantially equal to that of the elongated mouthpiece tubular portion and which total length of said mouthpiece exceeds that of said tobacco rod;

the length of the said cylindrical filter member being at least half as great as the length of the tobacco rod and at least one third as great as the length of the said tubular portion of the mouthpiece, the tobacco rod being connected to the elongated mouthpiece with a paper ring overlapping, at least, the surface of said cylindrical filter member, and the fibrous material of the mouthpiece being pressed to such a degree so as to ensure restoration of an open flow area of the tubular portion open flow area after removal of a compressive load under which the tubular portion has been fully compressed.

2. The smokers' article according to claim 1 wherein acetate fiber is used as the material for making said resilient mouthpiece and said cylindrical filter member.

3. The smokers' article according to claim 1 wherein an additional filter member is arranged between said tobacco rod and said cylindrical filter member.

4. The smokers' article according to claim 1 wherein an additional filter member is made of activated carbon.

5. The smokers' article according to claim 1 wherein said resilient and elongated mouthpiece made of a pressed fibrous material is wrapped in a paper sleeve and wherein a paper ring is connected to the outer surface of said paper sleeve with a glue.

6. The smokers' article according to claim 1 wherein said resilient and elongated mouthpiece made of a pressed fibrous material has a plasticized outer ourface.

7. The smokers' article according to claim 6 wherein a polyvinyl acetate emulsion is used as a plasticizer.

8. A smokers' article characterized in that it comprises a tobacco rod wrapped in a separate sleeve made of cigarette paper, a resilient and elongated mouthpiece which is connected to said rod and which is made of a pressed fibrous material and includes a filter member arranged on the tobacco rod side and made integral with a tubular portion of said mouthpiece, said filter member being a continuous cylinder with a diameter equal to that of the mouthpiece tubular portion and which total length of said mouthpiece exceeds that of said tobacco rod;

the length of the said cylindrical filter member being at least half as great as the length of the tobacco rod and at least one third as great as the length of the said tubular portion of the mouthpiece, the tobacco rod being connected to the elongated mouthpiece with a paper ring overlapping, at least, the surface of said cylindrical filter member, and the fibrous material of the mouthpiece being pressed to such a degree so as to ensure restoration of an open flow area of the tubular portion after removal of a compressive load under which the tubular portion has been fully compressed, wherein an additional filter member is arranged behind said cylindrical filter member inside said mouthpiece tubular portion.

9. The smokers' article according to claim 8 wherein acetate fiber is used as the material for making said resilient mouthpiece and said cylindrical filter member.

10. The smokers, article according to claim 8 wherein an additional filter member is arranged between said tobacco rod and said cylindrical filter member.

11. The smokers' article according to claim 8 wherein an additional filter member is made of activated carbon.

12. The smokers' article according to claim 8 wherein said resilient and elongated mouthpiece made of a pressed fibrous material is wrapped in a paper sleeve and wherein a paper ring is connected to the outer surface of said paper sleeve with a glue.

13. The smokers' article according to claim 8 wherein said resilient and elongated mouthpiece made of a pressed fibrous material has a plasticized outer surface.

14. The smokers, article according to claim 13 wherein a polyvinyl acetate emulsion is used as a plasticizer.

15. A smokers' article characterized in that it comprises a tobacco rod wrapped in a separate sleeve made of cigarette paper, a resilient and elongated mouthpiece which is connected to said rod and which is made of a pressed fibrous material and includes a filter member arranged on the tobacco rod side and made integral with a tubular portion of said mouthpiece, said filter member being a continuous cylinder with a diameter equal to that of the mouthpiece tubular portion and which total length of said mouthpiece exceeds that of paid tobacco rod;

the length of the said cylindrical filter member being at least half as great as the length of the tobacco rod and at least one third as great as the length of the said tubular portion of the mouthpiece, the tobacco rod being connected to the elongated mouthpiece with a paper ring overlapping, at least, the surface or said cylindrical filter member, and the fibrous material of the mouthpiece being pressed to such a degree so as to ensure restoration of an open flow area of the tubular portion after removal of a compressive load under which the tubular portion has been fully compressed, wherein said resilient and elongated mouthpiece made of a pressed fibrous material has a plasticized outer surface, wherein aid resilient and elongated mouthpiece made of a pressed fibrous material with the plasticized outer surface has a ring portion which is not covered with a plasticizer, is arranged behind said paper ring and provides additional air inflow in smoking.

16. The smokers' article according to claim 15 wherein acetate fiber is used as the material for making said resilient mouthpiece and said cylindrical filter member.

17. The smokers' article according to claim 15 wherein an additional filter member is arranged between said tobacco rod and said cylindrical filter member.

18. The smokers' article according to claim 15 wherein an additional filter member is made of activated carbon.

19. The smokers' article according to claim 15 wherein said resilient and elongated mouthpiece made of a pressed fibrous, material is wrapped in a paper sleeve and wherein a paper ring is connected to the outer surface of said paper sleeve with a glue.

20. The smokers' article according to claim 15 wherein a polyvinyl acetate emulsion is used as a plasticizer.

* * * * *